US006196353B1

(12) United States Patent
Howard

(10) Patent No.: US 6,196,353 B1
(45) Date of Patent: Mar. 6, 2001

(54) LADDER LEVELING ACCESSORY

(76) Inventor: Richard Howard, 3040 W. Hwy. 136, LaFayette, GA (US) 30728

( * ) Notice: Subject to any disclaimer, the term of this patent is extended or adjusted under 35 U.S.C. 154(b) by 0 days.

(21) Appl. No.: 09/544,189

(22) Filed: Apr. 6, 2000

(51) Int. Cl.[7] ..... E06C 7/42

(52) U.S. Cl. ..... 182/108; 182/107
(58) Field of Search ..... 182/107–111

(56) References Cited

U.S. PATENT DOCUMENTS 39,854 * 9/1863 Wemple .

FOREIGN PATENT DOCUMENTS

1184292 * 7/1959 (FR) ..... 182/107

* cited by examiner

*Primary Examiner*—Alvin Chin-Shue
(74) *Attorney, Agent, or Firm*—Alan Ruderman; Stephen J. Stark

(57) ABSTRACT

A ladder leveling accessory which may be attached to the legs of a ladder has a configuration which forms an apex remote from leg attachment arms positioned and carries an elongated peg which extends downwardly away from the arms at an angle to the plane in which the arms and thus the legs of the ladder are disposed. The peg may be in the configuration of a spike and, for use in loose or sandy substrates, there may be triangular shaped flanges. A flexible mat is secured above the spike to the apex and conforms to the configuration of the ground to provide further stabilization to the system.

4 Claims, 2 Drawing Sheets

LADDER LEVELING ACCESSORY

BACKGROUND OF THE INVENTION

This invention relates to a ladder leveling accessory which may be attached to a ladder to level and stabilize the ladder when positioned on a non-level ground surface.

There is a substantial amount of prior art directed towards attachments for a ladder, such as an extension ladder, for permitting use on uneven or unleveled surfaces.

Just a few examples of the prior art are illustrated in U.S. Pat. Nos. 3,948,352; 4,423,797; 4,683,982; 4,766,976; 4,802,471; 4,336,331; 5,174,412; 5,273,133; 5,325,936; 5,507,364; 5,526,898 and 5,619,222. This listing is not meant to be comprehensive of all ladder leveling devices, but merely exemplary of the prior art. For example, there are a substantial number of others of earlier dates referenced in these patents. Each of the known devices provides an extension member to be placed on the end of one or both legs of the ladder to permit two points of contact with the ground surface so that the steps or rungs of the ladder are disposed substantially horizontally. Many of these prior art apparatus are relatively expensive complicated devices. Examples of such are illustrated in U.S. Pat. Nos. 4,766,976; 5,174,412; 5,526,898 and 5,707,364. Others have slidable members connectable to at least one of he legs and secured thereto by various locking means once the steps or rungs are in the horizontal position. In many cases, this proves to be difficult and may involve trial and error since extension ladders may be relatively heavy.

SUMMARY OF THE INVENTION

Consequently, it is a primary object of the present invention to provide a ladder leveling accessory which is relatively inexpensive, simple to use and substantially foolproof to set up.

It is another object of the present invention to provide a ladder accessory attachable to the legs of a ladder that has a single point of engagement with the ground, such as a spike, and a relatively flexible base member through which the spike extends.

It is a further object of the present invention to provide ladder leveling apparatus connectable to the legs of a ladder and having a downwardly projecting spike disposed at an angle relatively to the axis of elongation of the ladder for penetrating a ground surface, and a flexible base member through which the spike extends and which may be positions itself onto the ground.

Accordingly, the present invention provides a ladder leveling accessory which is attached to the legs or stiles of a ladder, the accessory having a configuration which forms an apex remote from leg attachment arms and disposed centrally transversely intermediate the arms, an elongated peg being connected at the apex and extending away from the arms at an angle relatively to the plane in which the arms and thus the legs are disposed. The peg may be in the configuration of a spike so as to readily enter a penetratable ground surface such as natural terrain or may have a spherical end for disposition on a hard surface. Surprisingly, the system provides stability to a ladder on any surface despite the single point of contact. A flexible sheet or mat material is secured at the top of the spike which then conforms to the shape of the ground to provide further stabilization to the system when on a surface penetratable by the spike. Not only does the accessory perform satisfactorily when the terrain is inclined transversely, i.e., where one leg of the ladder would not touch the ground when the steps are horizontally disposed, but it also performs satisfactorily when the terrain slopes away from the surface against which the ladder is braced, an area where the prior art is deficient.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
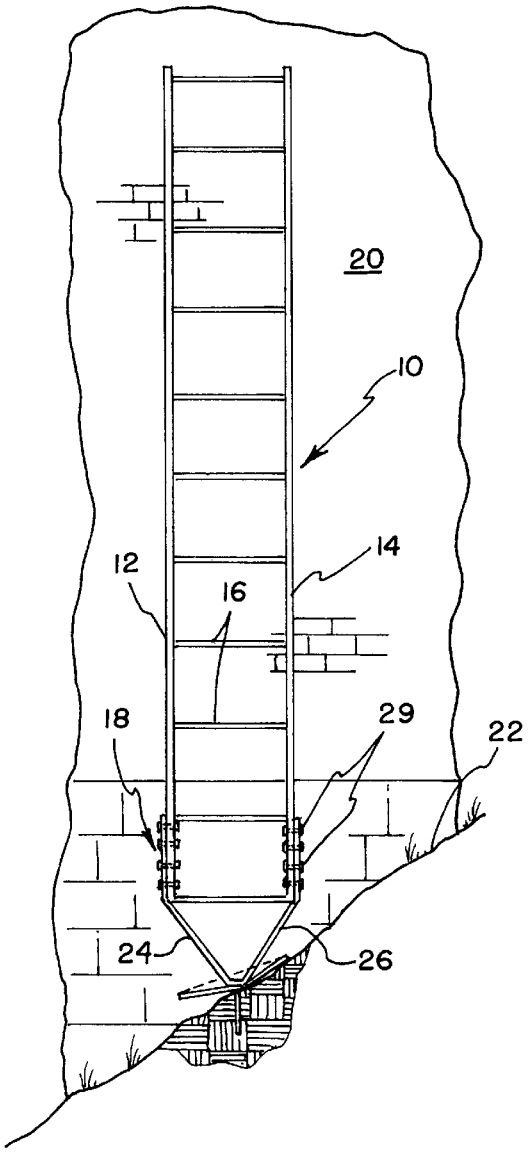
FIG. 1 is a vertical elevational view of a ladder having an accessory constructed in accordance with the principles of the present invention braced against the side of a building, only a fragmentary portion of which is illustrated.
Figure 2:
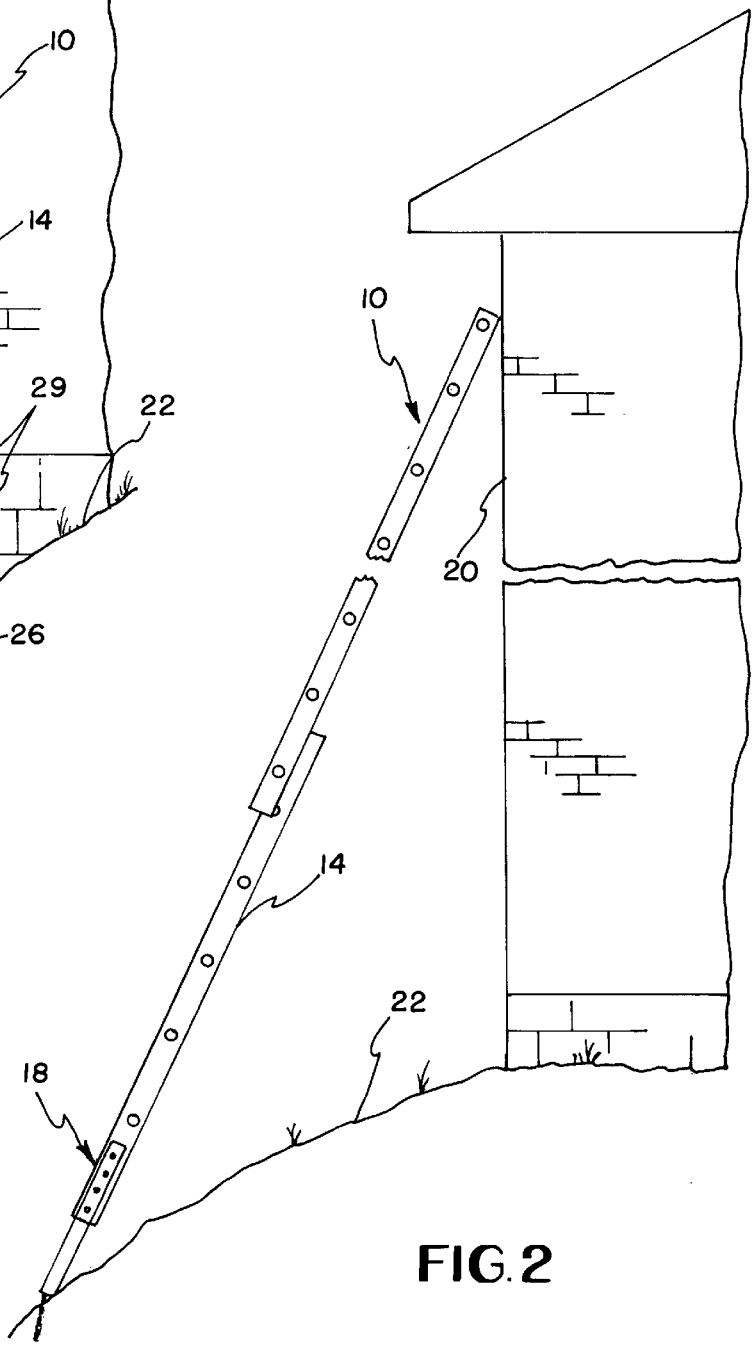
FIG. 2 is a side elevational view of an extension ladder having the accessory of the present invention attached thereto and disposed on a hill and braced against the side of a building, the mat being omitted for clarity of presentation.

Referring to the drawings, FIGS. 1 and 2 illustrate a ladder 10 which may be a conventional extension ladder, the ladder having side rails or legs 12, 14 connected together with steps or rungs 16 therebetween and having the leveling accessory generally illustrated at 18 secured to the bottom thereof. The upper end of the rails, as illustrated, are disposed in abutment with a structure such as a building wall 20. As illustrated in FIG. 1, the ground or terrain 22 on which the ladder with the accessory may be used may be inclined in the lateral direction wherein the rungs 16 of the ladder would not be horizontally disposed while the bottoms of the rails 12, 14 both engage the ground, and as illustrated in FIG. 2, the ladder with the accessory may be used in circumstances where the terrain 22 slopes away from the wall 20.

Figure 3:
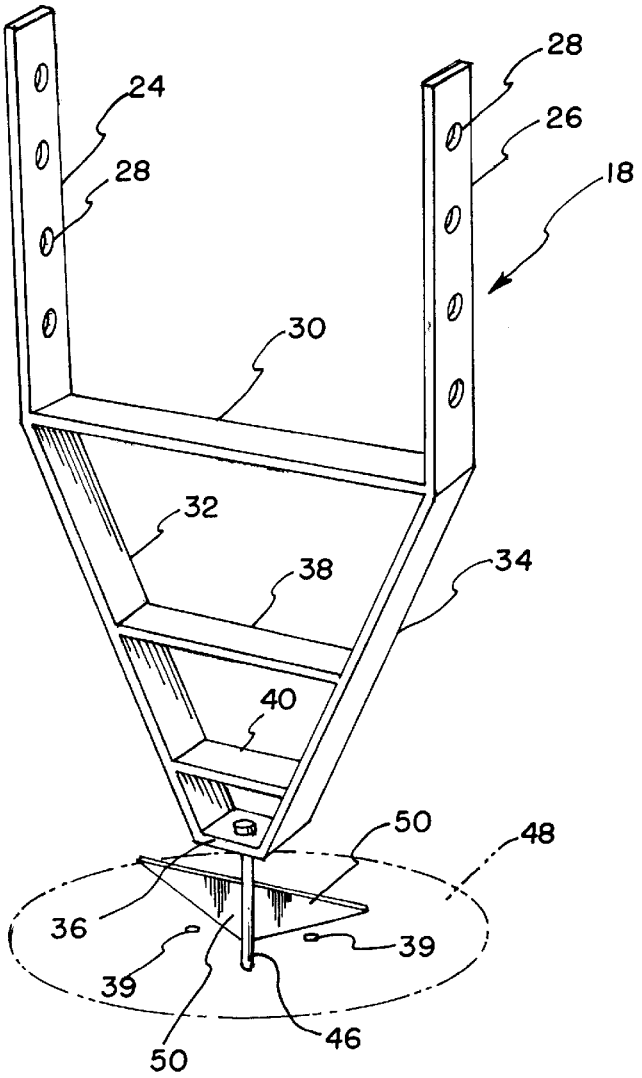
FIG. 3 is a perspective view of the ladder leveling attachment illustrated in FIGS. 1 and 2, but greatly enlarged relatively thereto.

As best illustrated in FIG. 3, the accessory 18 comprises a pair of parallel arms 24, 26 which are spaced apart by the width of the ladder, i.e., the spacing between the outer facing surfaces of the rails 12, 14 and which include bores 28 for receiving bolts 29 to fasten the arms 24, 26 to the rails 12, 14 of the ladder. At the lower end of the arms 24, 26, there may be a brace leg 30 extending between the arms which act as a stiffener or support member and may act as an additional step below the lower step of the ladder. Extending from the lower end of the arms 24, 26 at the brace 30 are a pair of inclined arms 32, 34 which may be unitary with the arms 24, 26 or may be fixed thereto by welding so as to be an integral part of the arms 24, 26. The arms 32, 34 extend at an angle toward each other and intersect a small apex member 36 at the lower ends thereof. A pair of additional strengthening members 38, 40 may be connected between the inclined arm 32, 34 intermediate the brace leg 30 and the apex member 36.

Firmly secured to and extending downwardly from the apex member 36 at an angle 42 to the longitudinal axis 44 of the arms 24, 26, 32, 34, i.e., the common plane in which the arms lie, is a peg 46 which may be a spike with a blunt end for penetrating a penetratable ground surface such as earth or natural terrain, the blunt end providing a degree of safety when not in use. The preferred angle 42 is approximately 25° and the accessory is connected to the ladder with the spike directed rearwardly, i.e., toward the wall 20 or other supporting vertical surface. Thus, as illustrated in FIG. 2, the ladder may be disposed on an inclined ground surface that slopes away from the supporting wall 20. If the support surface for the ladder is a rigid surface such as concrete or rock, then rather than the relatively pointed spike end of the accessory the peg may have a spherical member preferably in the form of a resilient sphere.

When the accessory is used on earth or other natural ground surfaces, as illustrated in FIG. 1, it has been found that it should be used in conjunction with a cape or mat 48 which may be formed from a flexible material such as polyvinylchloride (PVC) sheet of a thickness of approximately ⅛ of an inch and a width of about the width of the ladder, but a minimum of approximately 6 inches in radius, and thus no more than a few square feet. An elastomeric material such as neoprene or rubber may also be used as the mat. It is anticipated that the mat may also be formed from graphite. The material should have a roughened frictional surface at the bottom or underside. The mat is secured to the accessory at the top of the spike, at for example, the apex member 36 by rivets 37 or the like which pass through holes 39 in the mat 48. This helps stabilize the ladder accessory by conforming to the surface of the ground and also provides a frictional grip with the ground and prevents the ladder from rotating or pivoting while one climbs the first few steps of the ladder.

Figure 4:
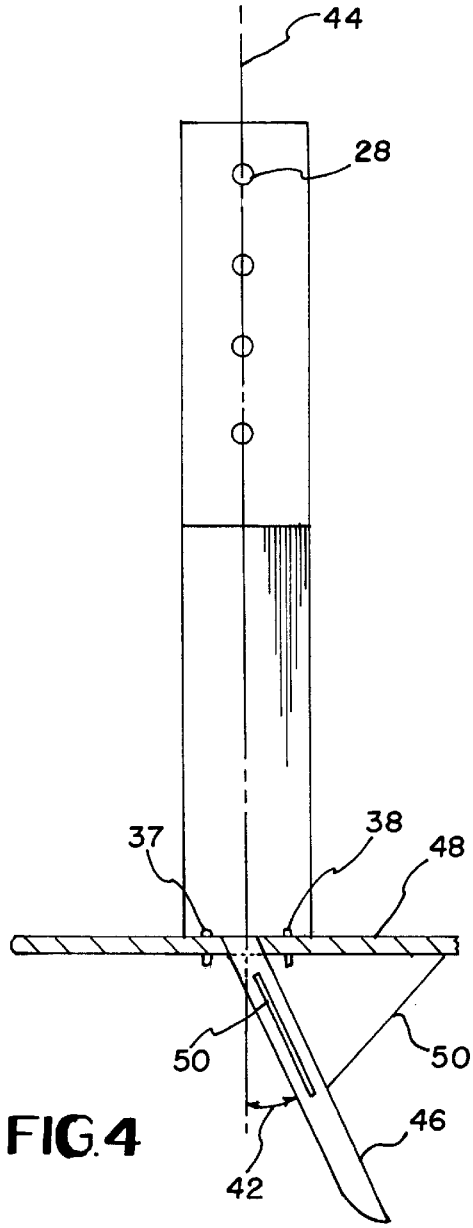
FIG. 4 is a side elevational view of the ladder leveling attachment with the mat illustrated in cross section.

When the accessory is to be used in a loose or sandy substrate, it is best if the spike has flange members 50 fastened to it, preferably there are three triangular flange members 50 secured as by welding to the spike at spaced apart dispositions laterally and on the rear of the spike so that they are 90 degrees apart at the sides and rear and the side flanges are spaced 180 degrees apart with no flange on the front of the spike as illustrated in FIGS. 3 and 4.

The ladder leveling accessory of the present invention is thus of a simple design that may be produced relatively inexpensively from aluminum or steel with the exception of the mat which, as aforesaid, may be constructed from PVC, elastomeric material or graphite or other materials having similar properties. It may be readily mounted on a ladder quickly and without special tools. All that is required is a drill to drill holes for the bolts 29. The accessory may be adaptable to a wide variety of ladder designs.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed therein is:

1. Ladder leveling apparatus for attachment to a ladder having a pair of spaced apart legs and a plurality of steps connected between said legs, said apparatus comprising a frame including a pair of spaced apart leg connecting arms spaced apart for attachment to the legs of said ladder, a pair of angularly inclined arms extending from said leg connecting arms and tapering toward an apex disposed laterally intermediate said leg connecting arms and said inclined arms, a peg comprising a spike fastened to said apex and having a free end extending in a direction remote from said arms, said free end of said peg extending away from said ladder for penetrating a natural ground surface when said apparatus is attached to a ladder, said apparatus including a flexible mat secured to said frame above said spike for providing additional stabilization to said apparatus and a ladder when disposed on said ground surface.

2. Ladder leveling apparatus as recited in claim 1, wherein said connecting arms and said inclined arms have axes of elongation which lie in a common plane, and said spike is disposed at an angle to said plane.

3. Ladder leveling apparatus as recited in claim 2, wherein said angle is approximately 25 degrees.

4. Ladder leveling apparatus as recited in claim 1, including three spaced apart flange members fastened to said spike for penetrating a loose substrate and providing additional gripping therewith.

* * * * *